US006482306B1

(12) United States Patent
Yager et al.

(10) Patent No.: US 6,482,306 B1
(45) Date of Patent: Nov. 19, 2002

(54) MESO- AND MICROFLUIDIC CONTINUOUS FLOW AND STOPPED FLOW ELECTROÖSMOTIC MIXER

(75) Inventors: Paul Yager, Seattle; Mark R. Holl, Shoreline; Andrew Kamholz, Seattle; Catherine Cabrera, Seattle; Katerina Macounova, Seattle, all of WA (US)

(73) Assignee: University of Washington, Seattle, WA (US)

( * ) Notice: Subject to any disclaimer, the term of this patent is extended or adjusted under 35 U.S.C. 154(b) by 0 days.

(21) Appl. No.: 09/404,454

(22) Filed: Sep. 22, 1999

Related U.S. Application Data

(60) Provisional application No. 60/101,303, filed on Sep. 22, 1998.

(51) Int. Cl.[7] ..... B01F 13/00

(52) U.S. Cl. ..... 204/600; 204/450; 366/341; 366/349; 137/808; 137/827

(58) Field of Search ..... 204/450, 454, 204/600, 601; 366/341, 349; 137/808, 825, 827

(56) References Cited

U.S. PATENT DOCUMENTS

| | | | | |
|---|---|---|---|---|
| 4,849,340 A | | 7/1989 | Oberhardt | 435/13 |
| 4,963,498 A | | 10/1990 | Hillman et al. | 436/69 |
| 5,223,114 A | * | 6/1993 | Zare et al. | 204/601 |
| 5,225,163 A | | 7/1993 | Andrews | 422/61 |
| 5,500,187 A | | 3/1996 | Deoms et al. | 422/58 |
| 5,639,423 A | | 6/1997 | Northrup et al. | 122/50 |
| 5,646,039 A | | 7/1997 | Northrup et al. | 435/287.2 |
| 5,674,742 A | | 10/1997 | Northrup et al. | 435/286.5 |
| 5,785,831 A | * | 7/1998 | Bek | 204/451 |
| 6,062,261 A | | 5/2000 | Jacobson et al. | |
| 6,086,243 A | * | 7/2000 | Paul et al. | 204/450 |
| 6,106,685 A | | 8/2000 | McBride et al. | |

FOREIGN PATENT DOCUMENTS

EP 0 558 233 A1 * 9/1993

OTHER PUBLICATIONS

Raymond, D.E. et al., "Continuous Sample Pretreatment using a Free–Flow Electrophoresis Device Integrated onto a Silicon Chip" (1994) *Anal. Chem.* 66:2858–2865.

Raymond, D.E. et al., "Continuous Separation of High Molecular Weight Compounds using a Microliter Volume Free–Flow Electrophoresis Microstructure" (1996) *Anal. Chem.* 68:2515–2522.

Fuhr et al, J. Microelectromech. Sys., vol. 1, Sep. 1992, pp. 141–146.*

Elwenspoek, M et al. (1994), "Towards integrated microliquid handling systems," J. Micromech. Microeng. 4(4):227–245, Month Unknown.

(List continued on next page.)

*Primary Examiner*—Robert J. Warden, Sr.
*Assistant Examiner*—Kaj K. Olsen
(74) *Attorney, Agent, or Firm*—Greenlee, Winner and Sullivan, P.C.

(57) ABSTRACT

An electroösmotic mixing device and a method for mixing one or more fluids for use in meso- or microfluidic device applications. The mixing device provides batch or continuous mixing of one or more fluids in meso- or microfluidic channels. An electric field is generated in the channel in substantial contact with chargeable surfaces therein. No alterations of the geometry of existing flow paths need be made, and the degree of mixing in the device can be controlled by the length of the electrodes, the flow rate past the electrodes, and the voltage applied to those electrodes. The degree of mixing is affected by choice of materials for the chargeable surface (in some cases by the selection of materials or coatings for channel walls) and the ionic strength of the fluids and the type and concentration of ions in the fluids. The ionic strength of fluids to be mixed is sufficiently low to allow electroosmotic flow. The method and device of this invention is preferably applied to fluids to having low ionic strength less than or equal to about 1 mM.

12 Claims, 5 Drawing Sheets

OTHER PUBLICATIONS

Evensen, H.T. et al. (1998), "Automated Fluid Mixing in Glass Capillaries," Rev. Sci. Instrumen.69(2):519–526, Feb.
Harrison, D.J. et al. (1993), "Micromachining a Miniaturized Capillary Electrophoresis–Based Chemical Analysis System on a Chip," Science 261:895–897, Aug.
Krog, J.P. et al. (1996), "Experiments and Simulations on a Micro–Mixer Fabricated Using a Planar Silicon/Glass Technology," ASME Intl Mechanical Engineering Congress & Exposition, Atlanta, ASME, Month Unknown.
Manz, A.C. et al. (1994), "Electroösmotic pumping and electrophoretic separations for miniaturized chemical analysis systems," J. Micromech. Microeng. 4(4):257–265, Month Unknown.

White, R.M. (1996), *Ultrasonic MEMS Device for Fluid Pumping and Mixing.* ASME Intl Mechanical Engineering Congress & Exposition, Atlanta, ASME, Month Unknown.

* cited by examiner

MESO- AND MICROFLUIDIC CONTINUOUS FLOW AND STOPPED FLOW ELECTROÖSMOTIC MIXER

This application takes priority under 35 USC 119(e) from U.S. Provisional Application Ser. No. 60/101,303, filed Sep. 22, 1998, which is incorporated in its entirety by reference herein.

This invention was made with support from DARPA under contract N660001-97-C-8632. The United States Government has certain rights in this invention.

CROSS-REFERENCE TO RELATED APPLICATIONS

BACKGROUND OF THE INVENTION

Mixing in microfluidic structures is a challenging problem because in such structures the Reynolds number is characteristically very small (often much less than 1 and rarely greater than 200). At such low Reynolds numbers turbulent mixing does not occur and homogenization of solutions occurs by diffusion processes alone. While diffusional mixing of very small (and therefore rapidly diffusing species) can occur in a matter of seconds over distances of tens of micrometers, mixing of larger molecules such as peptides, proteins, high molecular weight nucleic acids can require equilibration times of many minutes to hours over comparable distances. Such delays are impractically long for many chemical analyses. This is particularly true in many microanalytical systems in which a desire for rapid throughput is a major impetus for their development.

Mixing speed may be increased if the two or more fluids to be mixed can be layered in a multitude of very thin alternating layers. This is true because the characteristic time for near equilibrium by diffusion (in the absence of gravitational sedimentation artifacts) is given as $L^2/D$, where L is the distance between centers of adjacent fluid laminae, and D is the effective diffusivity of the slowest diffusion fluid constituent. Therefore, if the lamina thickness is decreased by a factor of 2 the mixing time decreases by a factor of 4. The effect associated with yet thinner laminae is obvious by extension. All active mixing devices operate on the principle of shredding and layering thinner and thinner laminae from macro- to meso- to microscale devices. This statement is true for devices that can induce turbulent flow as well. In turbulent mixing the shredding and layering of the lamina is random as are the fluid particle motions. Below are listed methods of active mixing with relevance to microfluidic mixing.

Ultrasonic/Piezoceramic Excitation

Ultrasonic plate waves created using piezoelectric films on silicon substrates have been used to generate recirculating flow patterns in reactor chambers (White 1996). This technique is also the subject of 3 U.S. patents (Northrup and White 1997). The use of piezoceramic excitation coupled to air and subsequently to a hundreds of picoliters stack of reagents has been demonstrated in glass capillaries (Evensen, Meldrum et al. 1998). In this method shear of the fluid near the wall significantly reduces the time required to achieve a homogeneous mixture. This device is fairly complex, requiring the addition of a transducer to the system. Excess ultrasound energy can damage components of the fluid.

Mixing Enhancement Using Passive Fluid Structures

Other researchers have attempted to create unique structures to achieve many fluid laminae using converging fluid flow profiles alone. One concept injects a multitude of microplumes of one reagent into another using a square 400 micronozzle in a 2 mm by 2 mm region (Elwenspoek, Lammerink et al. 1994). Another concept is to split and recombine fluid streams such that the lamina thickness is reduced each time the structure is reapplied (Krog, Branebjerg et al. 1996). These devices are difficult to manufacture. Mixing is also dependent on flow—in the absence of flow no mixing whatsoever occurs.

Electroösmotic Pumping

A few researchers have mixed one or more fluid streams using electroösmotic pumping as the means of delivering the fluid to a mixing junction (Manz, Effenhauser et al. 1994). However, this means of fluid delivery is not an active mixing configuration and only provides a means of delivering two fluids to a junction in a fashion similar to that which could be provided by any other pumping means.

All of the methods discussed above involve use of structures that are difficult to manufacture or require the presence (on or off the microfabricated device) of a bulky mechanical actuator. Some operate only when the fluid is flowing, and at a rate proportional to the fluid flow rate. What is needed is a generally applicable method for mixing arbitrarily small volumes of fluids that can be turned on and off at will, and that can be controlled by the user.

SUMMARY OF THE INVENTION

The present invention allows incorporation of a batch or continuous mixing capability into any meso- or microfluidic device by providing an electric field in a meso- or microfluidic channel. The electric field is generated by introducing two or more electrodes spaced by less than a few millimeters into a meso- or microfluidic channel to create a mixing region. Such electrodes may be made of any of several materials including gold. Electrodes may be plated or evaporated onto channel walls, or incorporated as separate pieces of metal, e.g., plates, wires or grids, into a channel made of nonconductive materials, such as polymers. The mixing region also contains chargeable surfaces that are substantially in contact with the electric field generated by at least some of the electrodes. These chargeable surfaces may be the walls of the channel, provided as a coating on those walls or provided as elements separate from the walls and appropriately positioned with respect to the electrodes. No alterations of the geometry of existing flow paths need be made, and the degree of mixing in the device can be controlled by the length of the electrodes, the flow rate past the electrodes, and the voltage applied to those electrodes. The degree of mixing can also be affected by choice of materials for the chargeable surface (in some cases by the selection of materials or coatings for channel walls) and the ionic strength of the fluids and the type and concentration of ions in the fluids. The method and device of this invention are preferably applied to fluids having low ionic strength less than or equal to about 1 mM. For example, electroosmotic mixing can be affected by varying the concentration of mono-, di-, tri- or tetravalent cations in the fluid (e.g., monovalent ions include $K^+$ or $Na^+$, divalent ions include $Ca^{2+}$ or $Mg^{2+}$, trivalent ions include $Al^{3+}$ and tetravalent ions include $Th^{4-}$).

By frustrating electroösmotic pumping by confining the fluid being pumped to a space that has closed ends in the direction of electroosmotic pumping, fluid is caused to recirculate within that space. We demonstrate that this electroosmotic recirculation of fluid, typically in the form of two contra-rotating vortices, is capable of rapidly mixing two or more fluids in that space, or of homogenizing a single fluid. When the distance or gap between two electrodes in a channel is less than a few millimeters, such mixing can occur within seconds and at voltages low enough to prevent formation of bubbles in the channel. The device can cause mixing in static fluids or in fluids flowing through a channel. In a specific embodiment, two electrodes form at least portions of two walls of the channel and the chargeable substrate is formed at least by portions of the remaining walls of the channel. In a rectangular shaped column of this embodiment, the axes of rotation of the vortices are parallel to the direction of flow in the channel. This mixer is applicable to aqueous and non-aqueous solutions, can be switched from "off" to mixing (i.e., to "on") at high rates with infinite gradations, has no moving parts and is extremely simple to manufacture. The ionic strength of the fluid or fluids to be mixed must be sufficiently low to allow electro0smotic flow. The mixing device and methods of this invention provide a solution to the universal problem of mixing small volumes of fluids. They are ideally suited for use in microfluidic chemical analytical systems such as lab-on-a-chip applications.

More specifically, the invention provides meso- and microfluidic channels having an electroösmotic mixing region. One or more fluids carried in the channel or introduced into the channel can be mixed in this region. The mixing region of the channel comprises at least two electrodes which are separated from each other by an electrode gap (at most the width or depth of the channel). Voltage can be applied across these electrodes to generate an electric field in the channel. The mixing region of the channel also comprises at least two surfaces that can carry a surface charge, i.e. chargeable surfaces, when in contact with the fluid or fluids in the channel. The chargeable surfaces are positioned in the channel with respect to the electrodes such that electric field generated by at least two of the electrodes extends to the chargeable surfaces to cause electroosmotic flow. In specific embodiments the chargeable surfaces and electrodes extend about the same length and are coextensive with each other along the channel. In additional specific embodiments two electrodes are on opposite sides of the channel and two chargeable surfaces are on opposite sides of the channel and the chargeable surfaces are preferably substantially perpendicular to the electrode surfaces.

The meso- and microfluidic channels of this invention can be any regular shape, including among others rectangular, square, trapezoid or circular or any irregular shape. The mixing region can, for example, be constructed by positioning two electrodes within a tubular channel with the remaining curved sides of the tube serving as the chargeable surfaces.

BRIEF DESCRIPTION OF THE DRAWINGS

FIG. 2A illustrates two rectangular electrodes with flat surfaces (which may be provided as a coating on the channel walls) in a round tubular channel where the curves channel walls (or coatings on those walls) provide chargeable surfaces. FIG. 2B illustrates two electrodes (which may be provided as a coating on the channel walls) in a trapezoidal shaped channel where the slanted wall (or coatings on those walls) provide chargeable surfaces. FIG. 2C illustrates two curved electrodes (which may be provided as a coating on the channel walls or as curved plates) in a round tubular channel where the chargeable surfaces are provided by the substrate walls. FIG. 2D illustrates a D-shaped channel having one curved and one flat electrode and where the chargeable surfaces are provided by the channel walls. FIG. 2E illustrates a hexagonal shaped channel provided with three electrodes where the substrate walls (or a coating on the walls) provides the chargeable surface. FIG. 2F illustrates a rectangular channel (which may be any shape) in which two electrodes are provided as wires in the channel and the chargeable surfaces are provided by one or more of the channel walls. FIG. 2G illustrates a rectangular channel provided with three electrodes, two of which are plates which may be provided as coating on the walls and the third of which is a wire near the middle of the channel. In this case, the voltage applied to the wire may be intermediate relative to that applied to the other two electrodes. Chargeable substrates are provided by the channel walls. FIG. 2H illustrates a rectangular channel (which may be any shape) and two electrodes on opposites walls of the channel. In this case, chargeable surfaces which extend into the channel from the walls are provided.

DETAILED DESCRIPTION OF THE INVENTION

Figure 1:
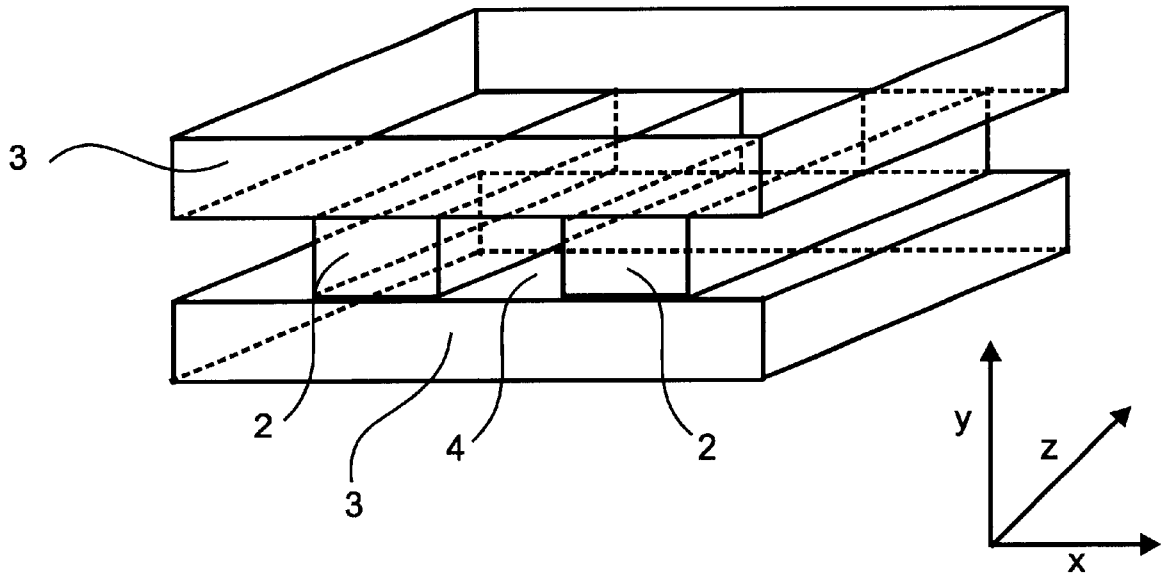
FIG. 1. Schematic drawings of an exemplary mixing device having two electrodes separated by a channel of fluid and sandwiched between two chargeable surfaces capable of generating electroosmotic pumping.
Figure 2A:
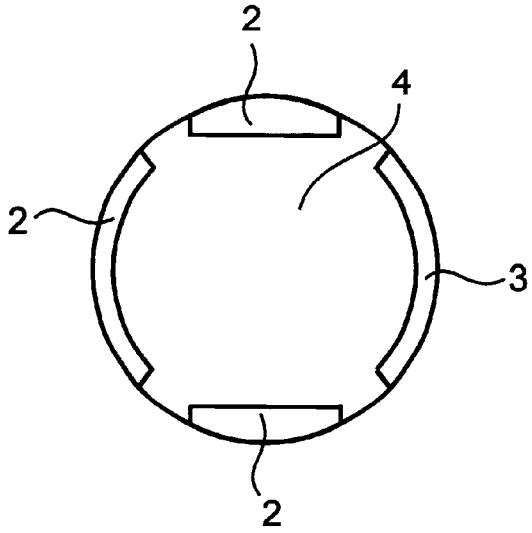
FIGS. 2A–2H are schematic drawings of cross-sections of various electroösmotic mixing regions of this invention.
Figure 2B:
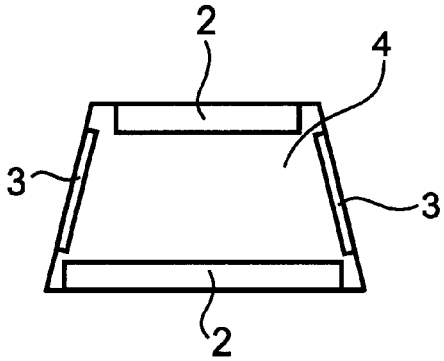
Figure 2C:
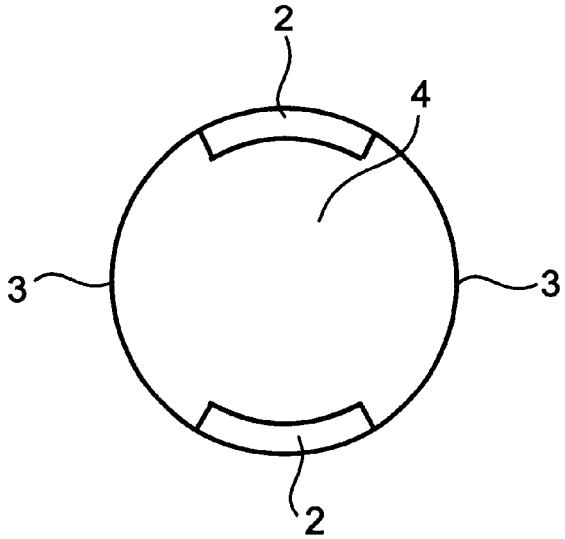
Figure 2D:
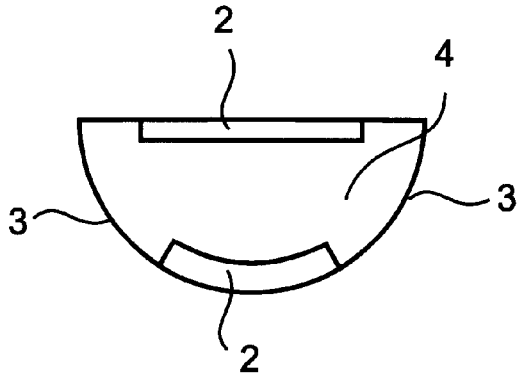
Figure 2E:
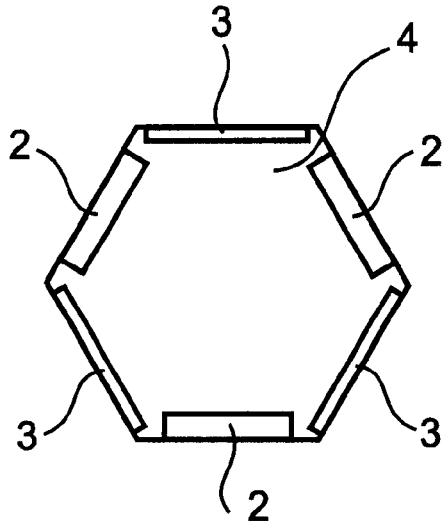
Figure 2F:
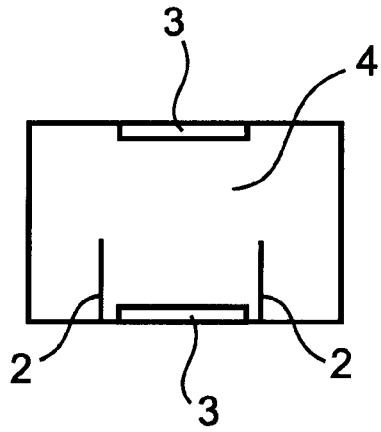
Figure 2G:
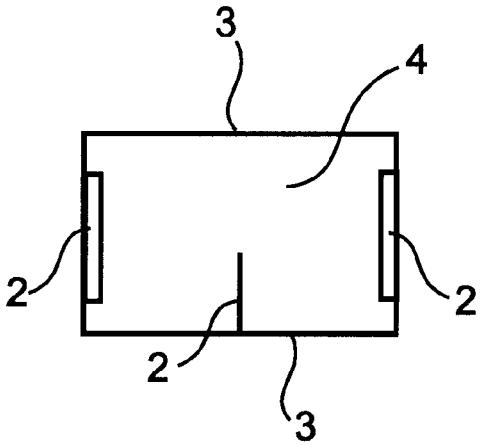
Figure 2H:
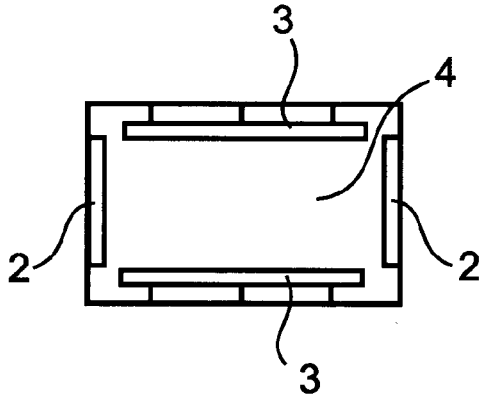

The invention includes a meso- or microfluidic device and method for using it to mix one or more fluids using electroosmotic pumping. The device as illustrated in FIG. 1 consists of at least two electrodes (2) made of any electrically conductive material. The electrodes face each other across a liquid channel (4) and are sandwiched between two chargeable surfaces (3) that have "fixed" electric charges on them when in contact with an appropriate fluid (FIG. 1). The electrodes and chargeable surfaces preferably have flat surfaces. The gap between the electrodes (on the x-axis) can be any distance, but is typically between 10 $\mu$m and 1 mm to allow for rapid mixing. A typical material for the chargeable surface is glass, although any material that carries a surface charge in the solvent used (and thereby supports electroosmotic pumping) is satisfactory. The gap between these materials can be any distance, although typical distances are within a factor of 10 of the inter-electrode spacing used in the same device. The channel length (z) is arbitrary. The electrodes are connected electrically to a controlled voltage and/or current source capable of maintaining a potential of between 0 and about 1.5 V (not shown).

Electrodes can be various shapes and can be provided as a coating or deposited layer on the channel wall. The electrodes can also be provided as wires or grids inserted into the channel. More than two electrodes can be provided within a mixing region and the electrodes in the mixing region can have different shapes and sizes. The channel may contain an odd or even number of electrodes. Application of voltage across or among the electrodes generates an electric field in the channel useful for generating electroösmotic flow. Chargeable surfaces may be various shapes and be provided by the channel walls (which may be flat or curved or have an irregular shape) with appropriate selection of wall materials. Chargeable surfaces may also be provided by forming a coating or deposited layer on one or more channel walls. Chargeable surfaces can also be provided as elements separate from the walls inserted into the channel, e.g., as plates or fingers extending from the walls. FIGS. 2A–2H illustrate in cross-section various exemplary mixing regions of this invention.

Chargeable surfaces have a fixed charge on their surface when in contact with an appropriate fluid. The surface charge present depends on the material employed and the pH, the ionic strength of the fluid and the type and concentration of ions in the fluid. Electroösmotic flow requires the presence of counterions in the fluid adjacent the charge surfaces. The net charge on the surface can, for example, be affected by the pH of the fluid in the channel. For example, a glass surface has a net negative charge in contact with neutral pH (pH about 7), a substantially neutral charge in contact with fluid at about pH 4 and can have a net positive charge in contact with fluid having a lower pH.

In general, the device geometry (the relative positioning of electrodes and chargeable substrates), the type of fluid (including pH, ionic strength and ion concentration), the type of material used for the chargeable substrate and the voltage applied to the electrodes are adjusted to cause electroosmotic flow. The extent of mixing in a meso- or microfluidic channel can be determined by following color changes on mixing of a fluid containing a pH dependent dye with a buffer (at a pH which causes a color change).

Mixing devices of this invention can be manufactured by a variety of techniques known in the art for manufacture of meso- and microfluidic devices.

A device was fabricated to test electroosmotic mixing. This device is comprised of copper electrodes sandwiched between a glass microscope slide and a large format cover slip. Fluid communication holes were machined in the glass slide. Aluminum fluid interconnect clamps at either end of the device facilitate the secure placement and fluid-tight attachment of previously reported molded silicone fluid interconnects. This particular device was used to examine the behavior of both electroösmotic mixing and electrophoretic mobility of particulates (polystyrene microspheres, and clay particulate) and pH sensitivity of different buffer solutions incorporating a pH sensitive fluorescent dye (SNARF-1). Two of these devices were fabricated. The distance between the electrodes is 1.9 mm. The distance between the glass windows of the flow cell is 635 $\mu$m. Glass flow cell windows were attached using a UV curing urethane adhesive.

Flow cell windows can be attached to the above-described mixing device with acrylate based contact adhesives, a consumer grade of which is commonly referred to as "double-sticky tape." A 3M-1151 adhesive system was used on a 50 $\mu$m Mylar carrier. Fabrication was achieved by first sandwiching a 125 $\mu$m copper electrode sheet between two 100 $\mu$m adhesive laminates and then placing the electrodes on the glass slide. Once secured to the glass slide the cover slip was applied. The distance between the electrodes is approximately 900 $\mu$m. The distance between the glass flow cell windows is 325 $\mu$m. We used one of the flow cells of this design in the bead migration experiment. This method of manufacture provides a rapid and cost effective method of making micro-electro-fluidic devices. Three devices were produced for test using this method.

Electroösmotic pumping in the presence of an electric field along the x-axis creates two contra-rotating vortices in the x-y plane that greatly enhance mixing. This can be used with a single fluid to randomize the position of suspended particulates that have sedimented to one side in a channel. If two or more different fluid streams are introduced into the device, they are effectively layered repeatedly to enhance the mixing rate above that observed in the presence of diffusive mixing alone. This mixer has no moving parts and can be turned off and on instantly. It can operate in the presence or absence of flow of the fluid stream(s) along the z-axis, and can thereby used in either a batch or continuous modes of operation.

Note that the action of current flow between the electrodes and the ensuing electrolysis will produce a pH gradient across the gap between the electrodes. By adjusting the wall materials and the buffer pH, two sets of contra-rotating vortices can be set up on either side of a position on the walls at which they are isoelectric. This may further enhance mixing.

Different modes of device operation are possible wherein fluid streams entering the device may be of the same or widely disparate ionic strengths, pH, and constituent concentrations. Fluids include aqueous solutions, nonaqueous solutions, suspensions of particles in aqueous solutions or other solvents. Factors that will influence the performance of this mixer include: the ionic strength of the solution(s), the pH values of the solution(s), the specific ions present in the solution(s), the buffering capacity of each solution, the presence of constituents of the solution(s) capable of fouling the electrodes or the walls, the voltage across the gap, and the chemical and physical states of the channel walls responsible for the electroosmotic effect.

Further, the invention may be used for any set of input stream mixing ratios.

The aspect ratio of the device, defined herein as the distance between the non-electrode surfaces, w, and the electrode surfaces, d, is typically between 1 and 10 in our devices although other aspect ratios will work. Mixing efficiency will decrease for very large or very small aspect ratios.

A further novel attribute of the invention is the ease with which the mixing region can be restricted by selective electrode placement along the length of the flow channel. A given channel may be provided with more than one mixing regions. Further, the mixing regions can be produced to conform with any channel or device geometry. The term channel is used generally herein to refer to a conduit of any shape or length that carries or holds a fluid. Typically, fluid is transported by pumping through a channel. Herein the term channel also refers to any meso- and microfluidic compartment, reservoir or container for holding or transporting fluid in which fluid mixing is desired. The term channel includes regions in which one or more fluids are combined. Channels of this invention can carry fluids. The term carry is used herein to refer to transport of fluids in the channel or holding of fluids in the channel. The mixing method and device of this invention can be employed with static fluids in a channel or with fluids that are flowing through a channel. Static fluids in a channel can for example be produced using stop flow techniques including the appropriate placement of valves which are actuated to start and stop flow.

The mixer geometry of this invention may be an integral component of devices fabricated by many techniques know to those skilled in the art. Examples include: 1) multilayered laminate structures in polymers or elastomers, 2) silicon or silicon-glass devices, single or multilayered, and 3) molded rigid fluidic structures with embedded electrodes.

Further, this invention also provides for the application of time dependent voltage profiles to the electrodes of the mixing region(s) for the purpose of optimal mixing efficiency and as a means of mitigating fouling of the electrode surfaces during extended operation.

Figure 3:
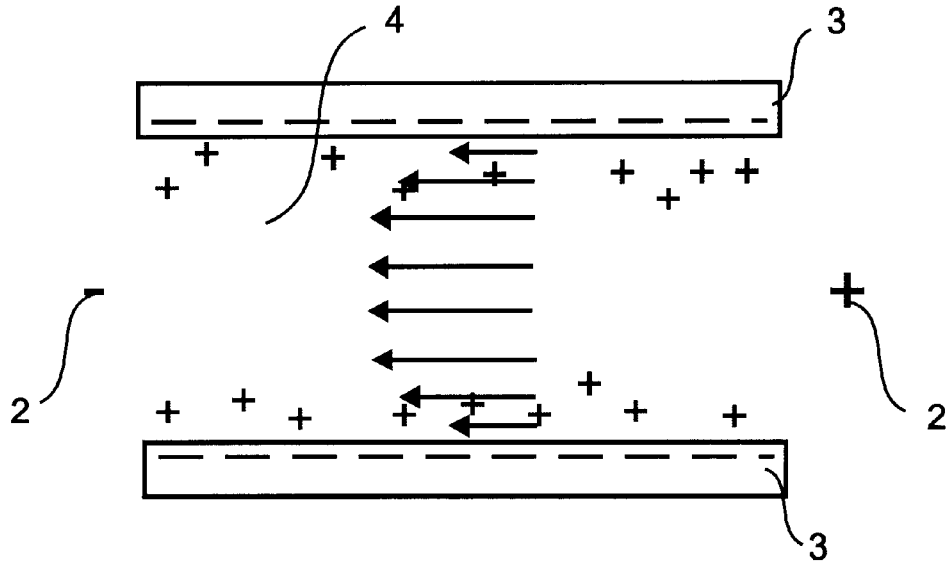
FIG. 3. A schematic representation of the charges in the electrostatic double layer that drive electroosmotic pumping. The bars represent the walls of a tube or channel, typically made of glass or silica. The arrows represent the flow velocity in the channel if the flow is unconstrained at the ends of the tube.

Electroösmosis has been known for decades to be caused by the interaction of the electrostatic field from electrodes with the charge on the walls of the most commonly used containers for fluids, such as silica and glass. As shown in FIG. 3, the fixed charges on the channel walls (negative at neutral pH and low ionic strength) create a double layer of mobile counterions in the first few nanometers. The effective thickness of this layer is strongly dependent on ionic strength. This layer moves in the presence of an applied field, and in the typical electrophoretic system (with open tube ends), the mobile counterion layer pulls the core of the fluid along with it. This is the basis of normal electroosmotic pumping. The concentration of the counterions and, hence, the pumping force depends on the concentration of counterions in the double layer, which, in turn is strongly affected by the local pH.

Figure 4:
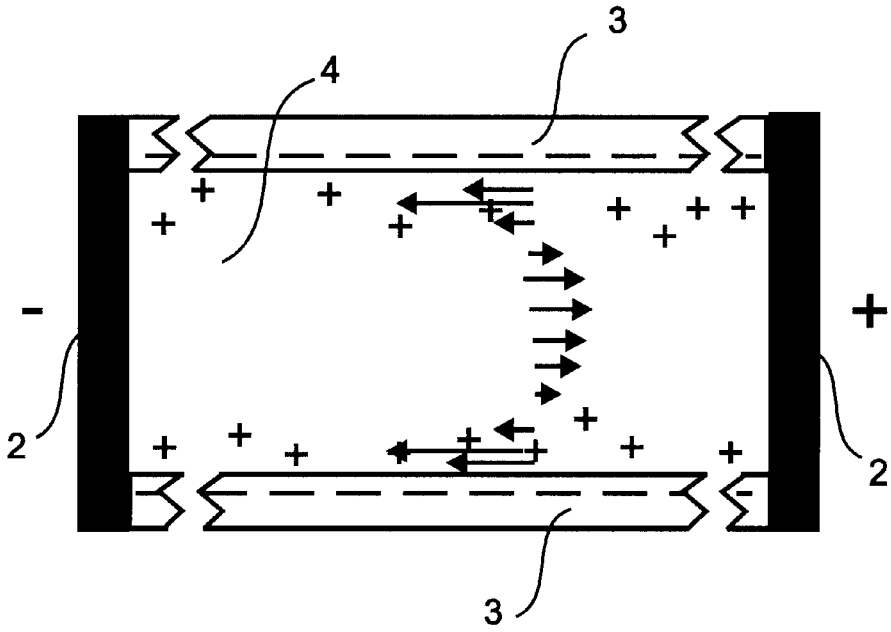
FIG. 4. Representation of the frustration of electroosmotic pumping that occurs when the system is capped in the directions of the field. In this way a recirculation is set up in which the flow of fluid toward the cathode near the walls is countered by an equal flow volume toward the anode in the center of the channel.

However, in a closed system in which the electrodes plug both ends no net flow is possible. Energy goes into the system and is ultimately dissipated as heat in the fluid. We refer to such a situation as "frustrated electroösmotic pumping". Such a system compromises by producing high velocity flow in the expected direction close to the walls, countered by an equal and opposite volume flow in the center of the channel, as shown in FIG. 4. This complication has been known for years as an interference in the measurement of electrophoretic mobility in macroscopic devices. The "true" electrophoretic mobility can be observed at the two planes in the system on which there is no net velocity.

Figure 5:
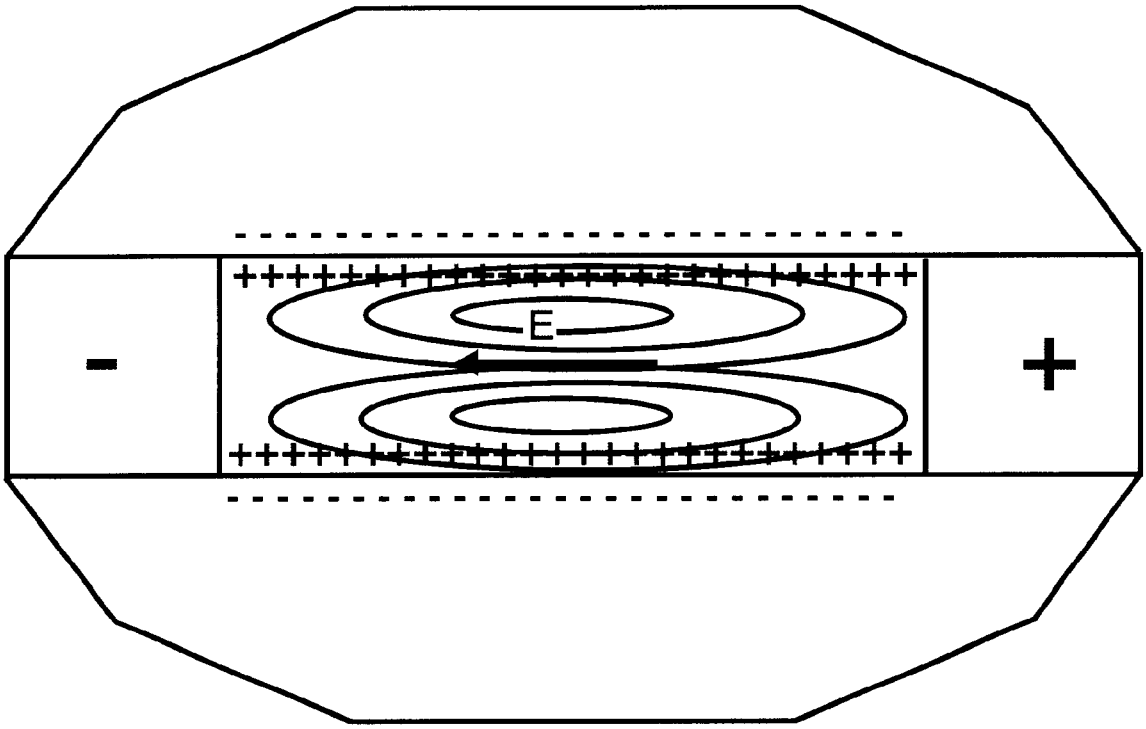
FIG. 5. Schematic representation of the flow lines generated in a channel under the influence of frustrated electroosmotic pumping.

If the electrode surfaces are close to the center of the channel, a complex flow field is established in the x-y plane as shown in FIG. 5. Lines of electric force point from the positive electrode to the negative electrode. Unmodified glass surfaces will have a negative surface charge causing closely bound positive counterions to be produced in the fluid boundary layer. These positive counterions interact with the electric field to cause electroosmotic flow along the glass surface and towards the negative electrode. Because the fluid will immediately encounter the negative electrode, a recirculating occurs. The elliptical arrows illustrate the flow streamlines.

Note that the electrolysis of water at the electrode surfaces may cause local changes in pH that will ultimately diffuse down concentration gradients to produce a uniform pH gradient from one electrode to the other. In this case it is possible that the local pH at a channel wall may cross the isoelectric point for the wall material. This will result in the generation of a total of 4 vortices that will also mix the fluid contents effectively.

The velocity of this flow depends linearly on the applied voltage. This flow "stirs" the contents of the channel. At a critical flow velocity it will lift sedimented particles off the bottom of the channel.

If the channel is pre-filled with two or more different fluids that are layered side-by side in a device as shown in FIG. 5, the recirculating flow drives the fluid on the right into that on the left along the walls, causing the two fluids to be layered, promoting rapid short path length diffusion and intermixing of the two fluids. Note that this flow is orthogonal to any possible flow along the z direction. Mixing will occur equally well in such a channel, with the exception that the flow field characteristic of the unstirred flow will be superimposed on the orthogonal mixing flow field.

The devices of this invention can be used in a wide range of applications in which rapid controlled mixing of two or more fluids, or the stirring of fluids, is required. Typical applications would be in microfluidic devices requiring mixing for chemical reactions, associated with chemical detection, chemical synthesis, chemical degradation, or analysis. Particular applications include:

Microanalytical chemistry, micro-total analytical chemical systems, biological and biochemical analyzers.

Mixing in microdevices for mixing cells with nutrients or removal of waste products.

Altering of corrosion rates in microchannels.

Prevention of separation of suspended particulates in a solution by sedimentation in small channels.

Prevention of clogging of channels by sedimentation.

Causing reactions to start at particular times by mixing of reacting fluids pre-loaded into a chamber.

Acceleration of diffusional mixing.

Rapid heating or cooling of microsystems by rapid mixing of solutions with positive or negative heats of mixing.

Fluidic display systems mediated by localized switching on and off of mixing of two or more fluids that combine to produce changes in fluorescence, absorption, scattering, or chemiluminescence.

Fluidic display systems mediated by localized changes in scattering or light absorption caused by alteration of the positions or orientation of particles in a fluid. In the broadest terms, this invention is the use of frustrated electroösmotic pumping perpendicular to an existing or potential flow for the purpose of mixing or agitating the fluid.

Those of ordinary skill in the art will appreciate that materials, methods and procedures other than those specifically exemplified herein can be readily employed in the practice of this invention. All such variants known in the art are encompassed within this invention.

These references are incorporated by reference to the extent not inconsistent herewith Elwenspoek, M., T. S. J. Lammerink, et al. (1994). "Towards integrated microliquid handling systems." *Journal of Micromechanics and Microengineering* 4(4): 227–245.

Evensen, H. T., D. R. Meldrum, et al. (1998). "Automated Fluid Mixing in Glass Capillaries." *Review of Scientific Instrumentation* Vol. 69(2): 519–526.

Krog, J. P., J. Branebjerg, et al. (1996). *Experiments and Simulations on a Micro-Mixer Fabricated Using a Planar Silicon/Glass Technology.* ASME International Mechanical Engineering Congress & Exposition, Atlanta, ASME.

Manz, A., C. S. Effenhauser, et al. (1994). "Electroösmotic pumping and electrophoretic separations for miniaturized chemical analysis systems." *Journal of Micromechanics and Microengineering* 4(4): 257–265.

Northrup, M. A. and R. M. White (1997). Microfabricated Reactor. U.S. Pat. No. 5,639,423, The Regents of the University of California.

Northrup, M. A. and R. M. White (1997). Microfabricated Reactor. U.S. Pat. No. 5,674,742, The Regents of the University of California.

Northrup, M. A. and R. M. White (1997). Microfabricated Reactor. U.S. Pat. No. 5,646,039, The Regents of the University of California.

White, R. M. (1996). *Ultrasonic MEMS Device for Fluid Pumping and Mixing*. ASME International Mechanical Engineering Congress & Exposition, Atlanta, ASME.

What is claimed is:

1. A microfluidic channel comprising an electroosmotic mixing region therein which comprises:

a) an interior surface;

b) first and second ends defining a flow axis, z, of said channel;

c) closures positioned at said first and second ends;

d) two or more electrodes:

i. that are on said interior surface;

ii. in which chargeable surfaces are between them on said interior surface;

iii. which are positioned at a common z axis position along said channel in said mixing region; or such that two electrodes form said closures; and e) means for applying a voltage across two or more of said electrodes to cause electroosmotic mixing.

2. The microfluidic channel of claim 1 wherein the electrode gap is between about 10 $\mu$m and about 1 mm.

3. The microfluidic channel of claim 1 wherein the gap between the chargeable surfaces is between about 1 to about 10 times the gap between the electrodes.

4. The microfluidic channel of claim 1 wherein said applied voltage is from 0 to about 1.5 v.

5. The microfluidic channel of claim 1 wherein the chargeable surfaces are glass.

6. The microfluidic channel of claim 1 wherein the electrodes are copper or gold.

7. The microfluidic channel of claim 1 wherein the chargeable surfaces are substantially perpendicular to the surfaces of the electrodes.

8. The microfluldic channel of claim 1 wherein one or more of said electrodes is a coating or deposit on said interior surface.

9. The microfluidic channel of claim 1 wherein one or more of said electrodes is a wire.

10. The microfluidic channel of claim 1 wherein one or more of the electrodes is a grid.

11. A microfluidic channel comprising an electroosmotic mixing region which comprises:

a) an interior surface;

b) first and second ends defining a flow axis Z, of said channel, c) two or more electrodes comprising one or more gold or copper coatings on said interior surface, wherein said electrodes:

i. are positioned at a common z axis position along said channel;

ii. are separated from each other by a distance of about 10 $\mu$m to about 1 mm, have two or more chargeable surfaces between them, and have a cross-channel separation distance, d; and d) means for applying a voltage across two or more of said electrodes to cause electroosmotic mixing; and e) at least two channel closures positioned upstream and downstream of said electrodes;

wherein said chargeable surfaces are glass, are substantially perpendicular to the surfaces of said electrodes, and have a cross-channel separation distance w such that w/d is about 1 to about 10; and wherein said applied voltage is from 0 to about 1.5V.

12. A microfluidic channel comprising an electroosmotic mixing region which comprises:

a) an interior surface;

b) first and second ends defining a flow axis Z, of said channel;

c) two or more electrodes comprising one or more gold or copper coatings on said interior surface, and which:

i. form one or more closures that are positioned at said first and second ends of said mixing region;

ii. are separated from each other by a distance of about 10 $\mu$m to about 1 mm, have two or more chargeable surfaces between them, and have a cross-channel separation distance, d;

d) means for applying a voltage across two or more of said electrodes to cause electroosmotic mixing; and e) at least two channel closures positioned upstream and downstream of said electrodes;

wherein said chargeable surfaces are glass, are substantially perpendicular to the surfaces of said electrodes, and have a cross-channel separation distance w such that w/d is 1 to about 10; and wherein said applied voltage is from 0 to about 1.5V.

* * * * *